US007634818B1

(12) United States Patent
Trujillo et al.

(10) Patent No.: US 7,634,818 B1
(45) Date of Patent: Dec. 22, 2009

(54) COMBINATION USER PROTECTION AND BABY SAFETY TOWEL

(76) Inventors: Lesther Trujillo, 5022 SW. 173rd Ave., Miramar, FL (US) 33050; Leidy D. Trujillo, 5022 SW. 173rd Ave., Miramar, FL (US) 33050

( * ) Notice: Subject to any disclaimer, the term of this patent is extended or adjusted under 35 U.S.C. 154(b) by 0 days.

(21) Appl. No.: 12/246,842

(22) Filed: Oct. 7, 2008

Related U.S. Application Data

(63) Continuation-in-part of application No. 12/215,370, filed on Jun. 27, 2008, now abandoned.

(51) Int. Cl.
*A41D 13/04* (2006.01)

(52) U.S. Cl. ..... 2/48; 2/269; 2/69

(58) Field of Classification Search ..... 2/48, 2/51, 52, 269, 69, 69.5, 49.1–49.5, 88, 105, 2/104, 46, 74, 76, 83, 85, 93, 108, 114, 50; D2/724, 860–864
See application file for complete search history.

(56) References Cited

U.S. PATENT DOCUMENTS

| | | | | | |
|---|---|---|---|---|---|
| 301,640 | A * | 7/1884 | Swan et al | 2/101 |
| 2,626,396 | A * | 1/1953 | Kanin | 2/269 |
| 2,651,041 | A * | 9/1953 | Sunderland et al. | 2/97 |
| 2,879,514 | A * | 3/1959 | Shapiro | 2/48 |
| 4,524,463 | A * | 6/1985 | Ogden | 2/105 |
| 4,685,154 | A * | 8/1987 | Smith | 2/48 |
| 4,951,318 | A * | 8/1990 | Harreld et al. | 2/48 |
| 5,694,643 | A * | 12/1997 | Fujiwara | 2/69 |
| D398,140 | S * | 9/1998 | Lion | D2/861 |
| 6,148,445 | A * | 11/2000 | Spruill | 2/125 |
| 6,505,367 | B2 * | 1/2003 | Griffin et al. | 5/655 |
| 6,536,047 | B1 * | 3/2003 | Mullaly | 2/48 |
| 6,986,163 | B2 * | 1/2006 | Dugan | 2/69 |
| 7,444,684 | B1 * | 11/2008 | Medina | 2/48 |
| 2006/0010555 | A1 * | 1/2006 | Hayes et al. | 2/69 |
| 2008/0092263 | A1 * | 4/2008 | Good et al. | 2/49.1 |
| 2009/0019616 | A1 * | 1/2009 | Smith et al. | 2/51 |

* cited by examiner

*Primary Examiner*—Amy B Vanatta
(74) *Attorney, Agent, or Firm*—Gold & Rizvi, P.A.; H. John Rizvi; Glenn E. Gold

(57) ABSTRACT

A combination user protector and baby safety towel is provided including a long front fabric member, a short back fabric member, two long sleeve fabric members, a belt fabric member, complementary belt-attachment members, and complementary sleeve-securing button and loop members. The front and sleeve fabric members are a soft, absorbent fabric.

Each sleeve is positionable. The loop engages the button to retract the sleeve for washing the baby. The sleeve is held extended for drying the baby by insertion of the user's thumb into the loop.

The combination user protector and baby safety towel allows the user to draw a wet baby out of a bath and immediately and conveniently wrap and dry the baby in the extended sleeve fabric members while cuddling the baby on the front fabric member. Thus safety and convenience are increased while the user's clothing is protected from wetness.

19 Claims, 4 Drawing Sheets

COMBINATION USER PROTECTION AND BABY SAFETY TOWEL

CROSS-REFERENCE TO RELATED APPLICATION

This application is a Continuation-In-Part of U.S. Non-Provisional patent application Ser. No. 12/215,370, filed on Jun. 27, 2008, which is now abandoned, and which is incorporated herein in its entirety.

BACKGROUND OF THE INVENTION

1. Field of the Invention

The present invention relates generally to wearable towel articles, and more particularly, to a combination baby safety towel and a wearable protector for the user who is attending the baby.

2. Description of the Prior Art

A baby requires frequent baths, yet bath time presents numerous difficulties and safety issues. Commonly a baby is bathed by a parent; the wet, wiggly, slippery baby is drawn out of the water; a nearby dry towel is grabbed; and then the baby is held in one arm against the parent's chest, while the other arm wraps the baby in a towel and dries the baby.

A primary concern is safety. The parent (or other attendant) may lose his or her grip on the wet baby in the transfer from the tub to the towel. An accident may result, which can be particularly hazardous due to the many hard surfaces often located nearby, such as the tub, toilet, sink, cabinets, and flooring. Even if the parent merely lets the baby slip, but recovers without an injury, the baby will be distraught—feeling the precariousness of the situation. What potentially could have been a pleasant experience suddenly becomes stressful and problematic.

Besides the safety issue, the baby may experience stress or discomfort during the awkward transfer. Picking up the dripping baby and then providing support with one hand, while wrapping the towel quickly and efficiently around the baby with the other hand, is tricky and inconvenient. Additionally, this procedure needs to be performed rather quickly to keep the wet baby from becoming chilled.

A separate problem is the wetting of the parent's clothing. As the dripping baby is supported in the single arm against the chest, the parent's clothing normally becomes saturated with water from the baby. Thus the parent optimally notes before the baby's bath time whether his or her clothing is suitable, and, if not, may need to change before the baby's bath. The parent may also need to change after the baby's bath, if his or her clothing becomes too damp.

The current invention solves these problems by providing an article of clothing that is worn protectively over the parent's clothing that also allows the parent to quickly, safely, and efficiently move, support, and dry the wet baby.

A similar problem occurring when drying a child after swimming or when washing a pet dog is also solved by the current invention.

Accordingly, there is an established need for a combination user protector and baby safety towel that increases safety and security for the baby, thus increasing the enjoyment of bath time for both parent and child, while providing protection for the parent's clothing.

SUMMARY OF THE INVENTION

The present invention is directed to a convenient combination user protector and baby safety towel that is worn by the user to efficiently wash the baby and to safely draw the wet baby out of the bathwater and to immediately and conveniently dry the baby—while protecting the user's clothing from dampness. The combination user protector and baby safety towel includes a front fabric member, a back fabric member, two sleeve fabric members, a belt fabric member, complementary belt-attachment members, and complementary sleeve-securing members. The fabric members are preferably of a soft, absorbent fabric.

The front fabric member (extending generally from the user's front neck area to the user's knee area), two sleeve fabric members, and the short back member connect to form a smock-like covering for the user. The belt fabric member is used to secure the combination user protector and baby safety towel to the user via the complementary belt-attachment members. Each sleeve can be held in a retracted or rolled-up position for convenience in bathing the child, by one set of complementary sleeve-securing button and loop members. The loop that engages the button to secure the sleeve in a retracted position is also slipped around the thumb of the user, thus retaining the sleeve in the extended position for drying the child.

Thus safety and convenience are increased, the comfort of the baby is increased as he or she is cuddled to the user's chest covered by the front fabric member while being dried, and the user's clothing is protected from dampness.

An object of the present invention is to provide a combination user protector and baby safety towel that is adapted to increase safety for a wet baby.

A further object of the present invention is to provide a combination user protector and baby safety towel that is adapted to protect the clothing of the user from wetness.

Another object of the present invention is to provide a combination user protector and baby safety towel that is adapted to allow the user to conveniently and securely hold a wet baby.

An additional object of the present invention is to provide a combination user protector and baby safety towel that is adapted to increase comfort for the baby.

These and other objects, features, and advantages of the present invention will become more readily apparent from the attached drawings and from the detailed description of the preferred embodiments, which follow.

BRIEF DESCRIPTION OF THE DRAWINGS

The preferred embodiments of the invention will hereinafter be described in conjunction with the appended drawings, provided to illustrate and not to limit the invention, where like designations denote like elements, and in which.

Like reference numerals refer to like parts throughout the several views of the drawings.

DETAILED DESCRIPTION OF THE PREFERRED EMBODIMENTS

Shown throughout the figures, the present invention is directed toward a convenient combination user protector and baby safety towel that is capable of increasing safety and comfort in the process of drawing a baby out of water and drying the baby, while protecting the clothing of the parent. The combination user protector and baby safety towel is a smock-like covering worn by a parent with a unique button and loop sleeve securing system, which allows the same loop to secure the sleeve in a retracted position for bathing (loop engages button) or to secure the sleeve in an extended position for drying (user slips thumb through loop).

While herein described for the particular application of drying a baby after a bath (FIG. 1), the combination user protector and baby safety towel is equally usable in other similar situations, such as, for example, drying a baby or small child after swimming or drying a dog or other pet after a bath.

Figure 1:
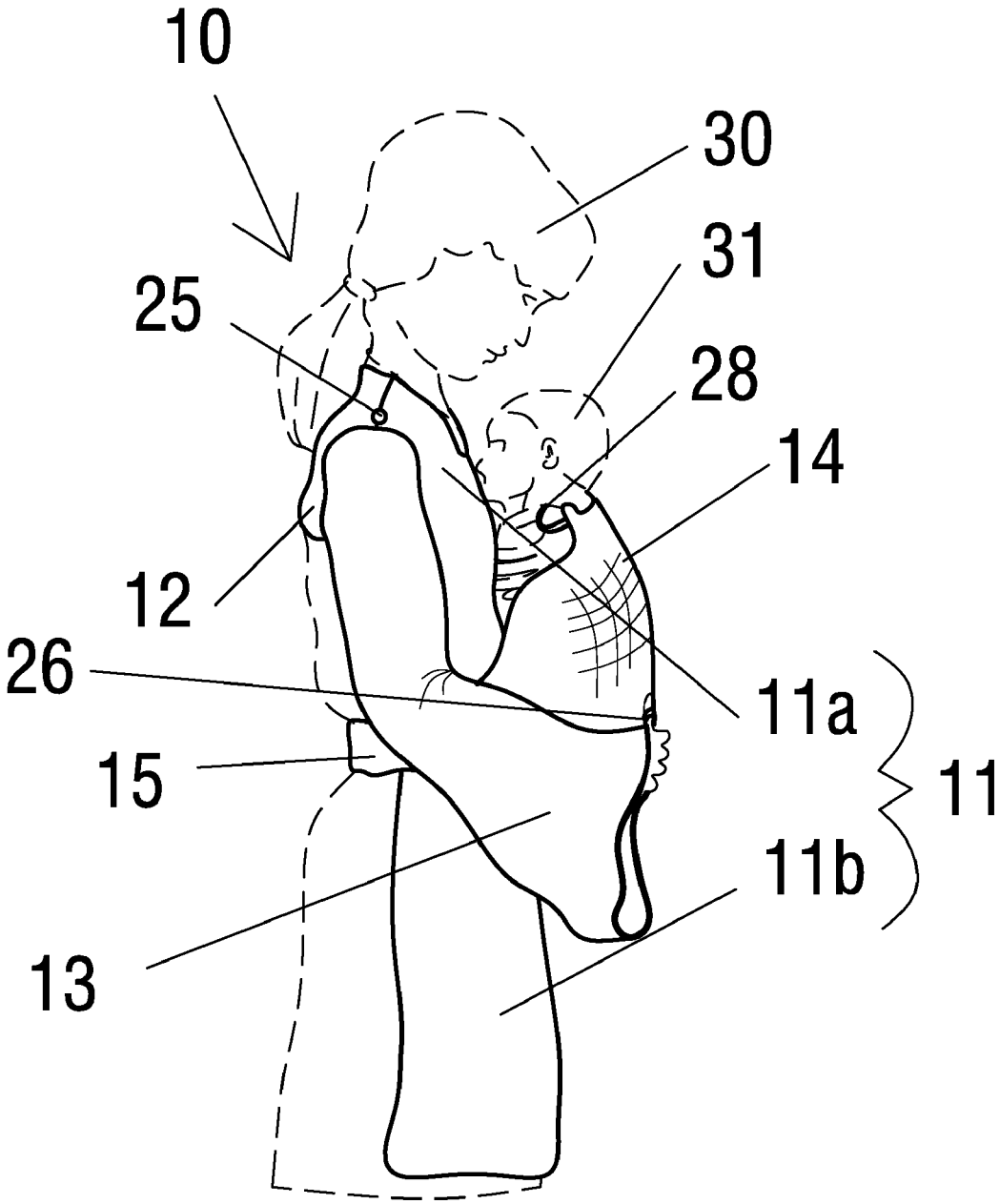
FIG. 1 is a side view showing a first embodiment of the combination user protector and baby safety towel of the present invention in use.
Figure 2:
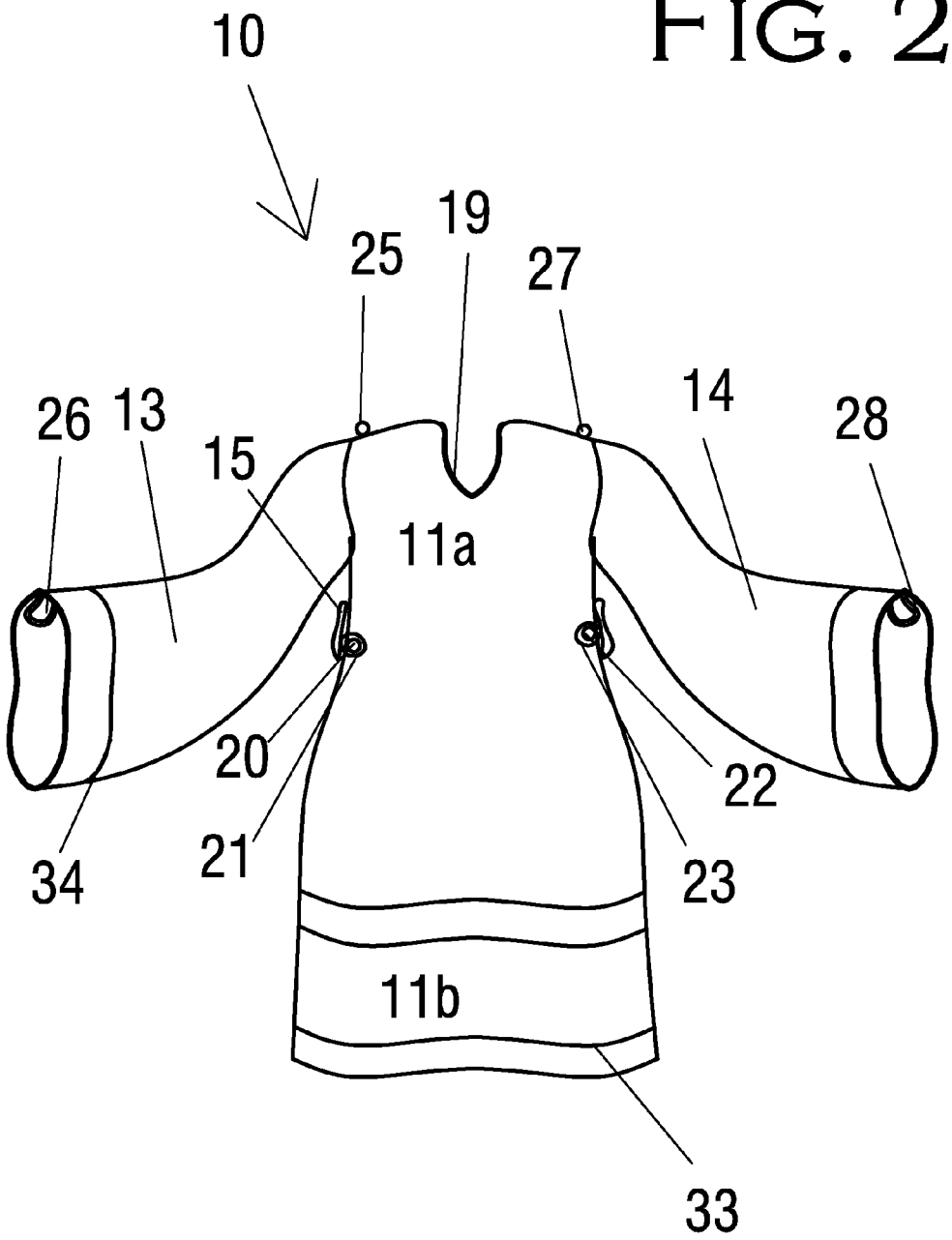
FIG. 2 is a front view of the first embodiment of the combination user protector and baby safety towel of the present invention.

Referring now to FIG. 1 and FIG. 2, a combination user protector and baby safety towel, shown generally as reference number 10, is illustrated in accordance with a preferred embodiment of the present invention. As shown, the combination user protector and baby safety towel 10 includes a front fabric member 11; a back fabric member 12; two sleeve fabric members 13, 14; a belt fabric member 15; at least one set of complementary belt-attachment members 20, 21 (FIG. 2); a first set of complementary button and loop sleeve-securing members 25, 26 (FIG. 2); and a second set of button and loop sleeve-securing members 27, 28 (FIG. 2).

The combination user protector and baby safety towel 10 is worn by the user 30 (the parent, caregiver, or other bath attendant) to dry the baby 31, while the baby 31 is supported in the arms of the user 30. The combination user protector and baby safety towel 10 is configured as a smock-like article of clothing which, prior to beginning the bath, is placed over the head of the user, with the user's clothing protected underneath. The combination user protector and baby safety towel 10 is secured around the user's waist via the complementary belt-attachment members 20, 21. The loops 26, 28 (FIG. 1) of the complementary sleeve-securing members are fitted over the user's thumbs to allow the sleeve fabric members 13, 14 to remain fully extended when the baby is picked up and supported. The loops 26, 28 are also used to secure the sleeves in a retracted position (FIG. 4), out of the way for washing and playing with the baby in the bathtub.

The front fabric member 11, back fabric member 12, and the two sleeve fabric members 13, 14 are preferably manufactured of a soft, absorbent material, such as cotton terry cloth or the like. A separate lining is preferably provided for the front fabric member 11, most preferably manufactured of a satin-type material matching the color of the front fabric member 11.

Figure 4:
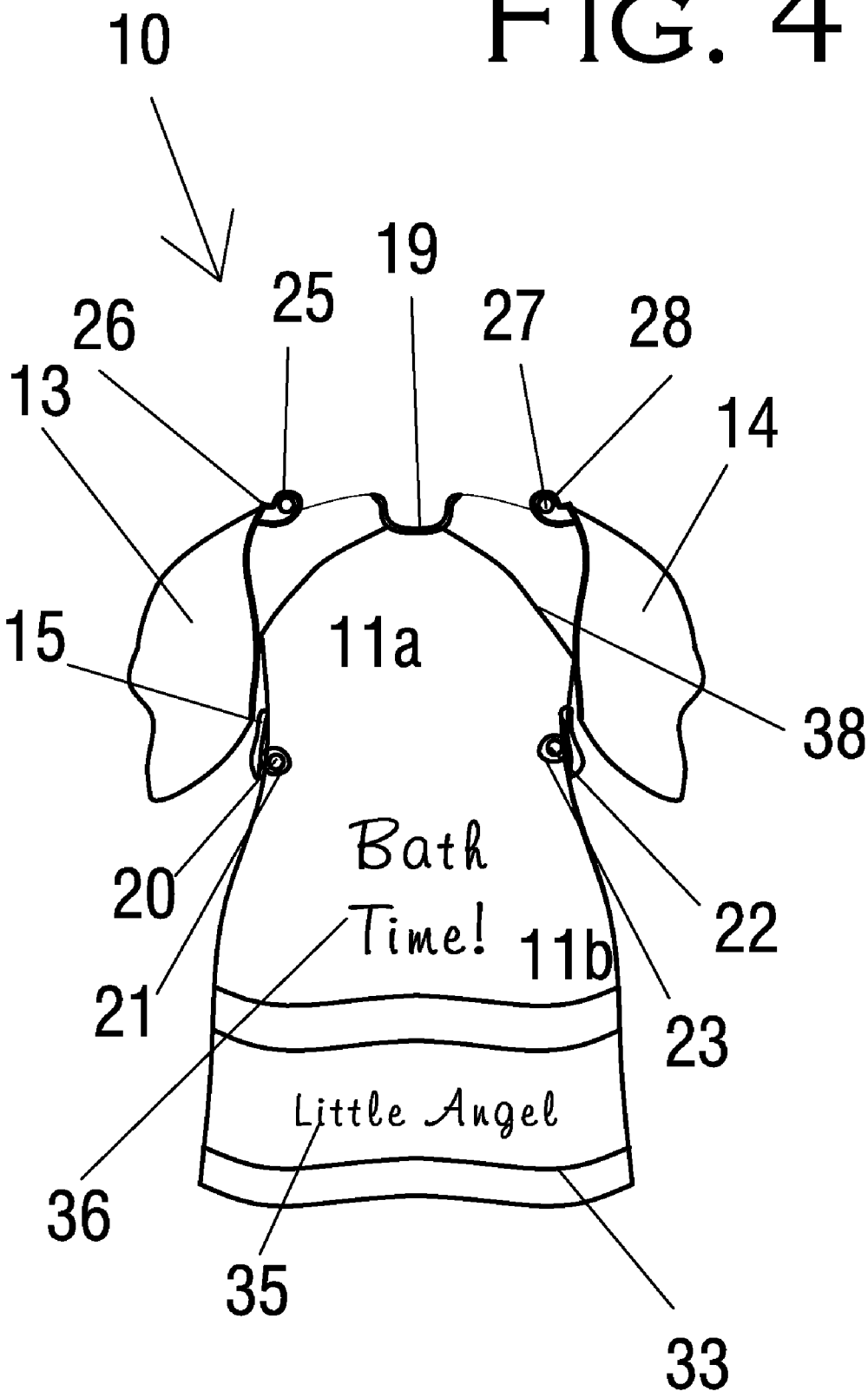
FIG. 4 is a front view of the second preferred embodiment of the combination user protector and baby safety towel of the present invention, illustrating the retracted sleeves, a shoulder variation, length variation, optional trim, and optional embroidery.

The front fabric member 11 is sized and configured to cover the front of the user 30. The front fabric member 11 may extend from the front neck area of the user 30 to the front thigh area of the user 30 (FIG. 4). However, preferably, the front fabric member 11 extends to the knee (FIG. 1, FIG. 2) or below the knee of the user 30 (not shown).

The front fabric member 11 has an upper segment 11*a* (generally above the waist of user 30) and a lower segment 11*b* (generally below the waist of user 30). The upper segment 11*a* has an upper edge, a central portion of which forms a front neck opening 19. Front neck opening 19 may be of any of a variety of typical neck opening types, such as, for example, a V-neck (FIG. 2), a scoop neck (FIG. 4), a square neck (not shown), or the like.

Figure 3:
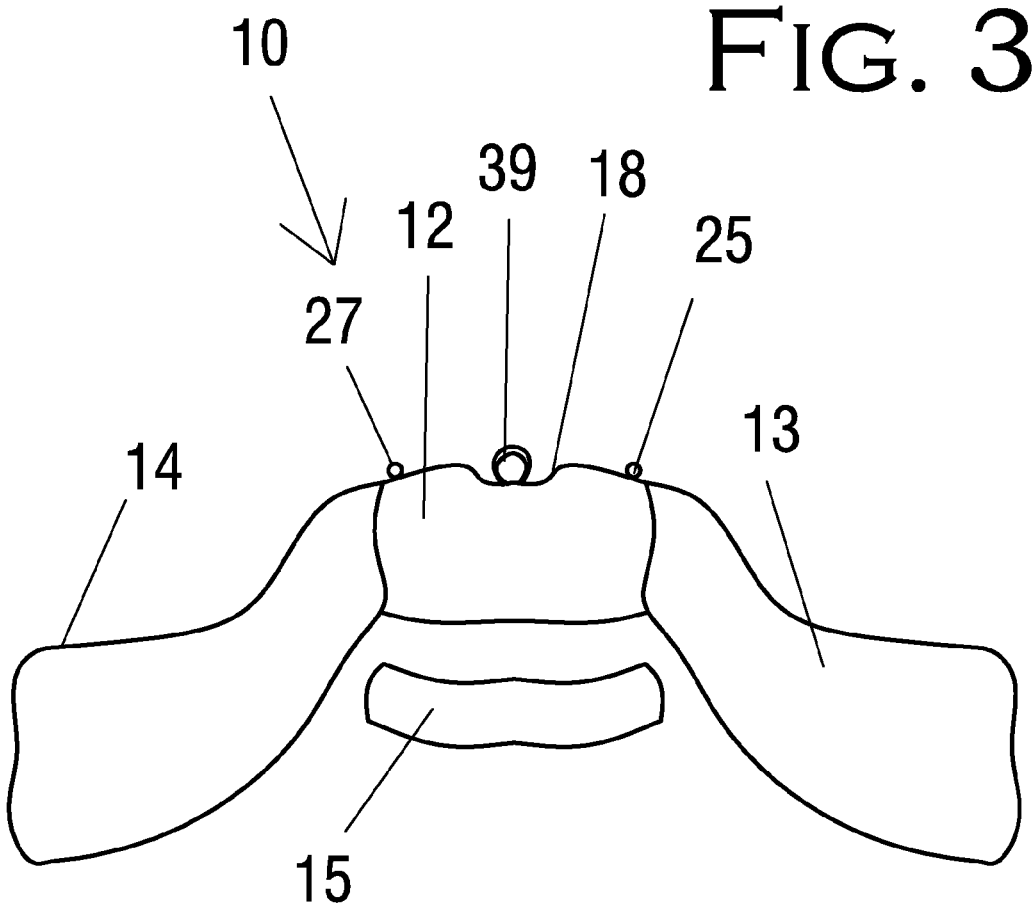
FIG. 3 is a back view of the first embodiment of the combination user protector and baby safety towel of the present invention.

The back fabric member 12 (FIG. 1, FIG. 3) is sized and configured to generally extend from the back neck area of the user 30 to the mid-back area of the user. The back fabric member 12 has an upper edge, with a central portion of its upper edge forming a back neckline 18. Back fabric member 12 provides support to hold front fabric member 11 and sleeve fabric members 13, 14 in position on the user 30. Preferably back fabric member 12 is manufactured of a satisfactorily sturdy fabric, such as denim or canvas, but most preferably denim matching the color of front fabric member 11.

The two sleeve fabric members 13, 14 are generally bell-shaped with a significantly wider distal portion and a narrower proximal portion. The proximal portions of both sleeve fabric member 13 and sleeve fabric member 14 are non-removably attached to the sides of back fabric member 12 and to the sides of the upper segment 11*a* of front fabric member 11. Sewing the sleeve fabric members 13, 14 to back fabric member 12 and to upper segment 11*a* with a suitably durable thread is preferred.

Front fabric member 11, back fabric member 12, and sleeves 13, 14 may be joined in any of several ways to form the smock-like protective covering for the user. As illustrated in FIG. 1 to FIG. 2, the front fabric member 11 and the back fabric member 12 are joined with the sleeves 13, 14 inset. Optionally, and preferably, the upper edge of each sleeve 13, 14 may form a portion of the neckline, as illustrated in the preferred embodiment of FIG. 4. In the preferred embodiment, the upper front portions of sleeve 13 and sleeve 14 are joined to the front fabric member 11, and the upper back portions of sleeve 13 and sleeve 14 are joined to the back fabric member 12, having slanted seams 38 from the underarm to the neck in front and back, such as are often referred to as raglan sleeves.

The two sleeve fabric members 13, 14 are configured to be wrapped around the back of the baby 31 as the user 30 lifts and holds the wet baby. The extra fabric at the distal ends of the two sleeve fabric members 13, 14 permits covering the entire back of the baby, from the neck to feet. Most preferably the two sleeve fabric members 13, 14 will be lined with a matching, satin material.

Two sets of complementary sleeve-securing members 25, 26 and 27, 28 are utilized to retain the two sleeve fabric members 13, 14 in a retracted position. Sleeve fabric members 13, 14 may be rolled or merely crumpled upward and secured by a first and second set of complementary members 25, 26 and 27, 28. Complementary sleeve-securing members 25, 26 and 27, 28 are preferably buttons 25, 27 with loops 26, 28. Buttons 25 and 27 are sewn on the opposite shoulder areas of front fabric member 11. Loops 26, 28 are sewn onto or near the distal edge of sleeve fabric members 13, 14, respectively. An inner reinforcement material may be included inside front fabric member 11 at the location of the button attachment to provide support and reinforcement.

As an additional feature, the loops 26, 28 may also be used to keep the sleeve extended to the maximum length, without encumbering or obstructing the freedom of the hands. This is achieved by inserting the thumbs of the user 30 into loops 26, 28 when the sleeves are extended (FIG. 1). Using this feature allows the user's fingers and thumbs to be free and unhampered, providing a proper grip on the baby for security.

The button-engaging loops 26, 28 are preferably formed of a sturdy material, such as denim or canvas. An additional hanging loop 39 (FIG. 3) is preferably sewn to an area of the back neck opening 18, allowing for convenient hanging to dry. Hanging loop 39 is sized and configured similarly to button-engaging loops 26, 28. Preferably the color of the material to form button-engaging loops 26, 28 and hanging loop 39 will match the color of front fabric member 11.

The belt fabric member 15 is removably attachable to the front fabric member 11 to secure the combination user protector and baby safety towel 10 around the back waist area of the user 30. Belt fabric member 15 is generally rectangular and is sized to reach approximately half way around the user's waist. At least one set of complementary belt-attachment members 20, 21 is used to attach belt fabric member 15 to front fabric member 11. Preferably a second set of complementary belt-attachment members 22, 23 is also utilized. If only one set of complementary belt-attachment members 20, 21 is used, the second end of belt fabric member 15 is preferably sewed to the waist area of front fabric member 11. Most preferably the two sets of complementary belt-attachment members 20, 21 and 22, 23 comprise a button 20, 22 and with a complementary loop 21, 23 sized to fit over the button 20, 22. Loops 21 and 23 are preferably disposed on the opposing ends of belt fabric member 15; buttons 20 and 22 are preferably disposed on front fabric member 11 near the waist. Other types of complementary belt-attachment members 20, 21 and 22, 23, such as snap fasteners, hook-and-loop type fasteners, a set of ties, male and female quick release buckles, or the like, are also within the scope of the invention.

Optionally, trim 33, 34, such as ribbons, fringe, piping, rickrack, or other decorations, can be attached to the front fabric member 11, back fabric member 12, sleeves 13, 14, and/or belt fabric member 15 in an aesthetically pleasing pattern. Trim 33, 34 can be sewn and/or glued on with adhesive, but most preferably is applied with adhesive and then sewn for most durability. Preferable locations for trim 33 include the lower edges, mid-section, sleeves, and neckline. Further, machine stitching may be used as a decorative feature. Most preferably ribbon is utilized along the lower edge and lower middle section, and machine stitching is utilized along the neckline. Additionally, embroidery 35, 36 (FIG. 4) may be used to enhance the visual appeal of the combination user protector and baby safety towel.

The combination user protector and baby safety towel 10 of the present invention is configured to fit a variety of sizes of users, but can easily be supplied in larger or smaller sizes if needed.

To use the combination user protector and baby safety towel 10 of the present invention, before bathing the baby or small child the user slips the combination user protector and baby safety towel 10 over his or her head. Then the user 30 secures belt fabric member 15 around his or her waist by engaging complementary belt-attachment member 20 with complementary belt-attachment member 21 and by engaging complementary belt-attachment member 22 with complementary belt-attachment member 23. The user 30 secures the sleeve fabric members 13, 14 in the retracted position by attaching loop 26 to button 25 and by attaching loop 28 to button 27. This keeps the long sleeve fabric members 13, 14 dry during the bath time. Also, this allows the user's hands and lower arms to be bare and unrestricted for using soap and shampoo to clean the baby or for playing with the baby in the bathtub.

When the bathing is completed the user releases sleeve fabric members 13, 14 by disengaging loop 26 from button 25 and by disengaging loop 28 from button 27 and extends the sleeve fabric members down to his or her wrist area. Then the user 30 most preferably slips his or her thumbs (FIG. 1) through loops 26, 28 to hold the sleeve fabric members 13, 14 at their full extension.

The user 30 removes the baby from the bathtub using both hands. The baby is moved into position cuddled on the user's front-fabric-member-covered chest area, supporting the baby with one arm covered in sleeve fabric member 13 or 14. Generally simultaneously, the other arm (covered in sleeve fabric member 13 or 14) is wrapped around the baby to provide support to the baby's back, to keep the baby warm, to encourage a snuggly and cozy feeling, and to dry the baby. The baby may then be placed in a safe location and the distal ends of sleeve fabric members 13, 14 used to further dry the baby.

From the foregoing, it will be apparent that the combination user protector and baby safety towel 10 of the present invention increases safety for a wet baby by allowing the caretaker to quickly receive the baby into the soft sleeve-fabric-member-covered arms, without reaching for and managing the positioning of a separate towel. Additionally, the use of the combination user protector and baby safety towel protects the clothing of the user from wetness.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

We claim:

1. A towel wearable by a user for drying a child, comprising:

a front fabric member formed of a single fabric piece, having an upper segment and a lower segment, wherein said upper segment comprises an upper front edge, and wherein said upper front edge is configured to form a front neck opening;

a back fabric member comprising an upper back edge, wherein said upper back edge is configured to form a back neck opening, and wherein said back fabric member is sized to generally extend from the lower portion of said user's neck to end above the user's waist;

two sleeve fabric members each of said two sleeve fabric members having a proximal portion and a distal portion, and wherein said proximal portion is non-removably attached to said front fabric member and to said back fabric member, wherein the joining of said front fabric member, said back fabric member, and said two sleeve fabric members forms a smock-like garment;

a belt fabric member removably attachable to said front fabric member for securing said front fabric member around the waist of said user;

a first set of complementary belt-attachment members configured to removably attach said belt fabric member to said front fabric member, wherein a first one of said first set of complementary belt-attachment members is disposed on said front fabric member and wherein a second one of said first set of complementary belt-attachment members is disposed on said belt fabric member;

a first set of complementary sleeve-securing members configured to removably secure a first one of said two sleeve fabric members in a retracted position, wherein a first one of said first set of complementary sleeve-securing members is disposed near said front neck opening and said back neck opening, and wherein a second opposing one of said first set of complementary sleeve-securing members is disposed on said distal portion of a first one of said two sleeve fabric members; and a second set of complementary sleeve-securing members configured to secure a second one of said two sleeve fabric members in a retracted position, wherein a first one of said second set of complementary sleeve-securing members is disposed near said front neck opening and said back neck opening, and wherein a second one of said second set of complementary sleeve-securing members is disposed on said distal portion of a second one of said two sleeve fabric members.

2. The towel wearable by a user for drying a child as recited in claim 1, wherein said distal portion of each of said two sleeve fabric members is at least 1.5 times, and less than 4 times, the width of said proximal portion of each of said two sleeve fabric members.

3. The towel wearable by a user for drying a child as recited in claim 2, wherein:

said first set of complementary sleeve-securing members comprises a first button and a first loop;

wherein said first loop is configured to engage said first button and also configured to allow insertion of a first thumb of said user;

said second set of complementary sleeve-securing members comprises a second button and a second loop; and wherein said second loop is configured to engage said second button and also configured to allow insertion of a second thumb of a user.

4. The towel wearable by a user for drying a child as recited in claim 3, wherein said front fabric member and said two sleeve fabric members are manufactured of an absorbent fabric material.

5. The towel wearable by a user for drying a child as recited in claim 4, wherein:

each of said two sleeve fabric members are sized to extend generally from the shoulder of said user to the wrist of said user; and said front fabric member is sized to generally extend from the front neck area of said user to the knee area of said user.

6. The towel wearable by a user for drying a child as recited in claim 4, wherein said back fabric member and said belt fabric member are manufactured of sturdy fabric.

7. The towel wearable by a user for drying a child as recited in claim 6, wherein said sturdy fabric is a denim fabric.

8. The towel wearable by a user for drying a child as recited in claim 4, comprising a second set of complementary belt-attachment members configured to removably attach said belt fabric member to said front fabric member, wherein a first one of said second set of complementary belt-attachment members is disposed on said front fabric member and wherein a second one of said second set of complementary belt-attachment members is disposed on said belt fabric member.

9. The towel wearable by a user for drying a child as recited in claim 8, wherein said two sleeve fabric members are non-removably attached to said front fabric member and to said back fabric member by sewing with thread.

10. The towel wearable by a user for drying a child as recited in claim 9, further comprising a hanging loop non-removably attached to said back fabric member near said back neck opening.

11. The towel wearable by a user for drying a child as recited in claim 10, wherein:

said first one of said first set of complementary belt-attachment members comprises a third button;

said second one of said first set of complementary belt-attachment members comprises a third loop;

said first one of said second set of complementary belt-attachment members comprises a fourth button; and said second one of said second set of complementary belt-attachment members comprises a fourth loop.

12. The towel wearable by a user for drying a child as recited in claim 11, wherein said absorbent fabric material is a cotton terry cloth fabric.

13. A combination protective article for a user and safety towel for a baby, comprising:

a front fabric member formed of a single fabric piece and sized to generally extend from the front neck area of said user to the knee area of said user, said front fabric member having an upper segment and a lower segment, wherein said upper segment comprises a front upper edge having a central front edge section and two outer front edge sections, with said central front edge section forming a front neck opening;

a back fabric member sized to generally extend from the back neck area of said user to the mid-back area of said user, said back fabric member comprising a back upper edge having a central back edge section and two outer back edge sections, with said central back edge section forming a back neck opening, and wherein said back fabric member is sized to generally extend from the lower portion of said user's neck to end above the user's waist;

two sleeve fabric members each of said two sleeve fabric members having a proximal portion and a distal portion, and wherein said proximal portion is sewn to said front fabric member and to said back fabric member, and wherein said distal portion of each of said two sleeve fabric members is at least 1.5 times, and less than 4 times, the width of said proximal portion of each of said two sleeve fabric members, and wherein the joining of said front fabric member, said back fabric member, and said two sleeve fabric members forms a smock-like garment;

a belt fabric member removably attachable to said front fabric member for securing said combination protective article for a user and safety towel for a baby around the waist of said user;

a set of complementary belt-attachment members configured to removably attach said belt fabric member to said front fabric member, wherein a first one of said set of complementary belt-attachment members is disposed on said front fabric member and wherein a second one of said set of complementary belt-attachment members is disposed on said belt fabric member;

a first button disposed on said upper segment of said front fabric member;

a first button-engaging loop disposed on said distal portion of a first one of said two sleeve fabric members, wherein said first button-engaging loop is configured to engage said first button to removably secure said first one of said two sleeve fabric members in a retracted position and wherein said first button-engaging loop is configured to allow insertion of a first thumb of said user to hold the first of said two sleeve fabric members in an extended position;

a second button disposed on said upper segment of said front fabric member; and a second button-engaging loop disposed on said distal portion of a second one of said two sleeve fabric members, wherein said second button-engaging loop is configured to engage said second button to removably secure said second one of said two sleeve fabric members in a retracted position and wherein said second button-engaging loop is configured to allow insertion of a second thumb of said user to hold the second of said sleeve fabric members in an extended position.

14. The combination protective article for a user and safety towel for a baby, as recited in claim 13, wherein:

said front fabric member is manufactured of a soft, absorbent fabric;

said two sleeve fabric members are manufactured of a soft, absorbent fabric material;

said back fabric member is manufactured of a sturdy fabric material; and said belt fabric member is manufactured of a sturdy fabric material.

15. The combination protective article for a user and safety towel for a baby, as recited in claim 14, wherein:

said soft, absorbent fabric is a cotton terry cloth material; and said sturdy fabric material is a denim material.

16. The combination protective article for a user and safety towel for a baby, as recited in claim 15, further comprising:

a hanging loop sewn to an inner surface of said back fabric member near said back neck opening; and decorative trim disposed on said lower segment of said front fabric member.

17. A method for allowing a user to protect his or her clothing, while holding and drying a wet child by using a combination user protector and baby safety towel, comprising:

donning said combination user protector and baby safety towel over said user's said clothing;

engaging a first complementary belt-attachment member with a first complementary belt-attachment member;

engaging a second complementary belt-attachment member with a second complementary belt-attachment member to secure said combination user protector and baby safety towel around the waist of said user;

securing a first sleeve in a retracted position by attaching a first loop on a first sleeve distal sleeve edge to a first button on a front fabric member;

securing a second sleeve in a retracted position by attaching a second loop on a second sleeve distal sleeve edge to a second button on a front fabric member;

washing said child by manual use of said user's hands;

detaching said first loop from said first button to extend said first sleeve;

detaching said second loop from said second button to extend said second sleeve;

inserting a first thumb of said user into said first loop;

inserting a second thumb of said user into said second loop;

drawing said child out of water;

supporting said child with a first hand of said user while drying said child with said first sleeve; and wrapping a second hand of said user around the back of said child to support said child and to dry said child with said second sleeve.

18. The method for allowing a user to protect his or her clothing, while holding and drying a wet child by using a combination user protector and baby safety towel, as recited in claim 17, further comprising:

positioning said child against said front fabric member on the chest area of said user.

19. The method for allowing a user to protect his or her clothing, while holding and drying a wet child by using a combination user protector and baby safety towel, as recited in claim 18, wherein:

said first button is disposed on a first shoulder area of said front fabric member; and said second button is disposed on an opposing second shoulder area of said front fabric member.

* * * * *